United States Patent [19]

Roosmann

[11] Patent Number: 4,736,682

[45] Date of Patent: Apr. 12, 1988

[54] FUSE FOR SELF-DESTROYING SHELL

[75] Inventor: Karl-Heinz Roosmann, Düsseldorf, Fed. Rep. of Germany

[73] Assignee: Rheinmetall GmbH, Düsseldorf, Fed. Rep. of Germany

[21] Appl. No.: 946,579

[22] PCT Filed: Nov. 7, 1985

[86] PCT No.: PCT/EP85/00595

§ 371 Date: Oct. 1, 1986

§ 102(e) Date: Oct. 1, 1986

[87] PCT Pub. No.: WO86/03828

PCT Pub. Date: Jul. 3, 1986

[30] Foreign Application Priority Data

Dec. 19, 1984 [DE] Fed. Rep. of Germany ..... 3446314

[51] Int. Cl.[4] ..... F42C 9/16

[52] U.S. Cl. ..... 102/269; 102/265

[58] Field of Search ..... 102/269–274, 102/265, 266, 244, 245, 237, 204

[56] References Cited

U.S. PATENT DOCUMENTS

| | | | |
|---|---|---|---|
| 1,531,717 | 3/1925 | Rémondy | 102/265 |
| 2,838,999 | 6/1958 | Corsi | 102/269 X |
| 3,115,094 | 12/1963 | Simmen | 102/270 X |
| 3,422,764 | 1/1969 | Kaiser | 102/269 X |
| 3,633,510 | 1/1972 | Bernardin | 102/265 X |
| 3,838,644 | 10/1974 | Prochnow et al. | 102/476 |

FOREIGN PATENT DOCUMENTS

| | | | |
|---|---|---|---|
| 565993 | 4/1958 | Belgium | 102/269 |
| 325292 | 6/1918 | Fed. Rep. of Germany . | |
| 1101225 | 3/1961 | Fed. Rep. of Germany . | |
| 889561 | 10/1943 | France . | |
| 1121878 | 6/1963 | France . | |
| 606978 | 11/1978 | Switzerland . | |

*Primary Examiner*—David H. Brown

*Attorney, Agent, or Firm*—Spencer & Frank

[57] ABSTRACT

A warhead having a longitudinal axis comprises a housing containing an explosive charge and an axially displaceable firing pin assembly. The latter has a hollow body, as well as an initial fuse, a final fuse and a pyrotechnical delay segment installed in the hollow body. An axially oriented point projects from the pin body, and a needle is affixed to the housing and is oriented axially in a direction toward the initial fuse. A first safety slide is radially displaceably held in the housing for blocking an axial motion of the firing pin assembly towards the needle, and a second safety slide is radially displaceably held in the housing for blocking an axial motion of the firing pin assembly in a direction away from the needle. A detonator is held in the second safety slide such that in one position of the second safety slide it is out of axial alignment with the point and in another position thereof it is in axial alignment with the point for allowing contact between the point and the detonator.

5 Claims, 2 Drawing Sheets

FUSE FOR SELF-DESTROYING SHELL

BACKGROUND OF THE INVENTION

The invention relates to a warhead having a warhead housing containing a charge, such as a shaped charge; and a primer housing connected with the warhead and containing an impact detonator having a firing pin cooperating with a detonator.

Such a warhead is known from German Offenlegungsschrift DE-OS No. 22 42 930. The known warhead includes a warhead housing containing a shaped charge as well as an impact detonator connected with the warhead housing and having a firing pin movable in an axial direction. Large numbers of these warheads are transported by means of missiles or projectile carriers to a target area and are discharged there. When impacting on the target, the firing pin is pushed forward because of its inertia and fires the detonator which, in turn, detonates the charge in the warhead, preferably a shaped charge.

SUMMARY OF THE INVENTION

An object of the invention is to expand the known warhead by giving it the ability to self-destruct.

This object and others to become apparent as the specification progresses, are accomplished by the invention, according to which, briefly stated, the warhead has a longitudinal axis comprising a housing containing an explosive charge and an axially displaceable firing pin assembly. The latter has a hollow body, as well as an initial fuse, a final fuse and a pyrotechnical delay segment installed in the hollow body. An axially oriented point projects from the pin body, and a needle is affixed to the housing and is oriented axially in a direction toward the initial fuse. A first safety slide is radially displaceably held in the housing for blocking an axial motion of the firing pin assembly towards the needle, and a second safety slide is radially displaceably held in the housing for blocking an axial motion of the firing pin assembly in a direction away from the needle. A detonator is held in the second safety slide such that in one position of the second safty slide it is out of axial alignment with the point and in another position thereof it is in axial alignment with the point for allowing contact between the point and the detonator.

The invention has the advantage of avoiding duds which might endanger friendly troops, since the self-destructive device activates the charge of the warhead even in case the impact detonator malfunctions and thereby makes it innocuous. In addition this increases the reliability of the warhead, since even in case the impact detonator should malfunction the self-destruct device will detonate the charge and thereby makes the warhead target-effective.

DESCRIPTION OF THE PREFERRED EMBODIMENTS

Figure 1:
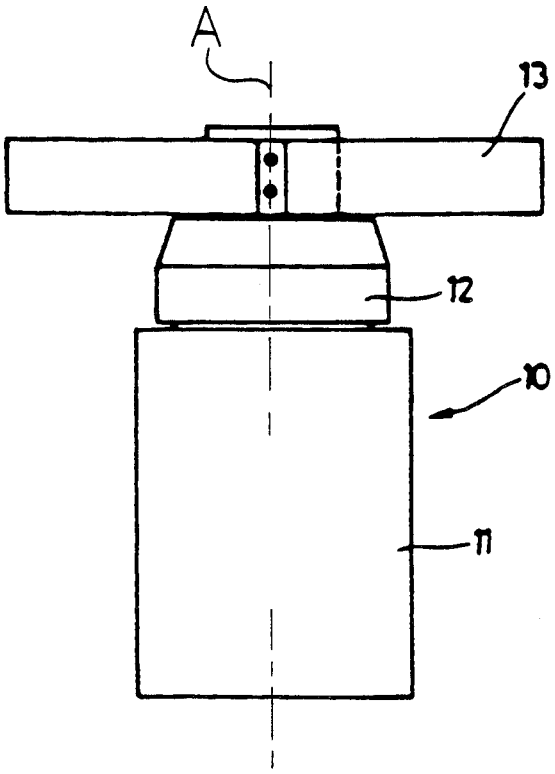
FIG. 1 is a schematic side view of a warhead incorporating the invention.

FIG. 1 shows schematically a side view of a warhead 10. The warhead 10 consists of a warhead housing 11, containing a charge, preferably a shaped charge. A primer housing 12 is connected with the warhead housing 11 and is disposed towards its rear and contains an impact detonator. A spin brake 13 is fastened to the primer housing and reduces the spin after the warhead 10 has been discharged from the spin-stabilized projectile carrier and thereby improves the flight stability of the warhead 10 as it descends into the target area.

Figure 2:
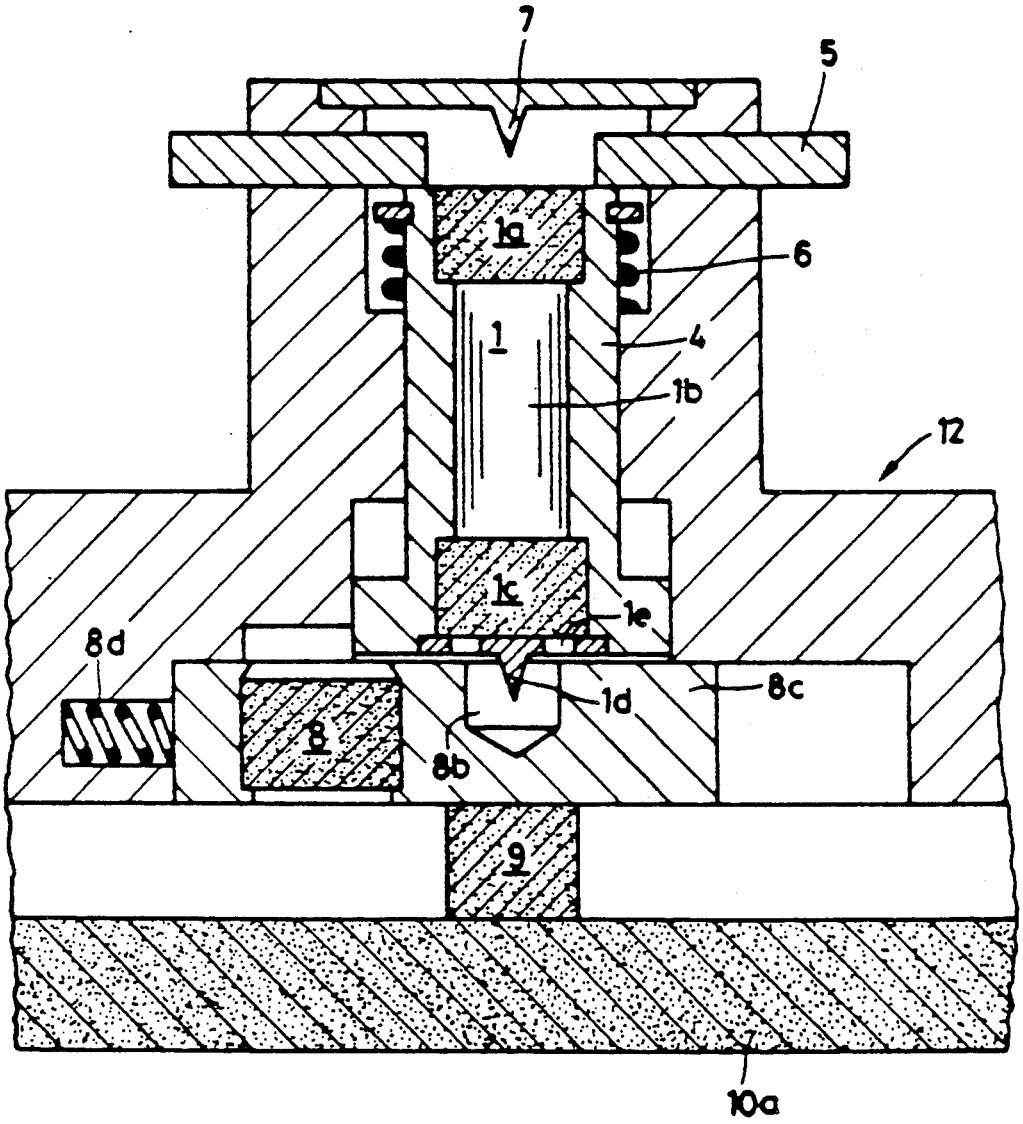
FIG. 2 is an enlarged sectional view of a preferred embodiment of the invention.

Turning now to FIG. 2, the impact detonator includes a firing pin 1, immobilized in the safe position but disposed axially movably when activated, when it cooperates with a detonator 8 which detonates the charge 10*a* via a transfer charge 9, when required.

The firing pin 1 includes an axially hollow pin body 4 which contains in its interior, starting from its rear, an initial fuse 1*a*, a pyrotechnical delay segment 1*b* and a final fuse 1*c*. Furthermore, a needle 7 is disposed fixedly in the primer housing 12 and cooperates with the initial fuse 1*a*.

The self-destruct and fuse device functions as follows: FIG. 2 shows the safe position wherein the firing pin 1 is immobilized by means of the safety means 5, which can be removed in a radial direction relative to the longitudinal axis A of the warhead 10. The safety means 5 is constructed in the form of a slide, and it cannot move in an axial direction, even under impact stress. The point 1*d* of the firing pin 1 rests in a blind bore 8*b* of a radially displaceable detonator carrier 8*c*, which is biased by a pressure spring 8*d* and is prevented by the point 1*d* from movement in a radial direction. After activation, i.e. removal in a radial direction of the safety means 5, the pressure spring 6, acting in an axial direction, presses the firing pin 1 backwards, whereby the needle 7, fixed to the housing 12, activates the initial fuse 1*a* which, in turn, activates the pyrotechnical delay segment 1*b*. At the same time the point 1*d* has moved out of the blind bore 8*b* and has released the detonator carrier 8*c* which now, spring-biased, moves in a radial direction in such a way that the detonator 8 comes to rest under the point 1*d* of the firing pin 1, thereby coming into alignment with the transfer charge 9 and completing a pyrotechnical firing chain with the charge 10*a*. Until impact on the target of the warhead, the point 1*d* of the firing pin 1 is in a ready-to-fire position above the detonator 8. At the moment of firing impact the firing pin 1, because of inertia, is propelled in an axial direction against the force of the pressure spring 6 and pierces the detonator 8 which, in turn, detonates the charge 10*a* via the transfer charge 9. In case of a malfunction of this firing chain the self-destruct device alternatively comes into play. In the meantime the pyrotechnical delay segment 1*b* has burned through to the final fuse 1*c* and has activated it, whereby a flame front passes through the bores 1*e* in the area of the point 1*d* and acts upon the detonator 8, which had not been activated because of the malfunction, with such a high temperature that it does function. This assures at least the self-destruction of the warhead, even if the main ignition chain has malfunctioned. The self-destruct device also regularly assures that, even if the main ignition chain has malfunctioned, the charge 10*a* is timely detonated and that the warhead 10 becomes target-effective as planned.

In another exemplary embodiment of the invention the final fuse 1*c* is advantageously explosively constructed, thereby achieving an even greater assurance that the charge 10*a* is activated.

In an exemplary embodiment of the invention the duration of burning of the pyrotechnical delay segment

*1b* was set at approximately 8 to 10 seconds. The pyrotechnical delay section consisted of a per se known pyrotechnical composition with a diameter of approximately 3 mm and of a cover of approximately 1.5 mm thickness; the entire length of the pyrotechnical delay segment was approximately 18 mm.

I claim:

1. A warhead, having a longitudinal axis, comprising (a) a warhead housing containing an explosive charge;

(b) a primer housing axially joining said warhead housing;

(c) a firing pin assembly axially displaceably received in said primer housing and including (1) a hollow body having opposite first and second axial ends;

(2) an initial fuse installed in said hollow body at the first end thereof;

(3) a final fuse installed in said hollow body at the second end thereof;

(4) a pyrotechnical delay segment installed in said hollow body between and in operative connection with said initial fuse and said final fuse; and (5) a point affixed to said hollow body at said second end thereof, said point being axially oriented in a direction away from said second end;

(d) a needle affixed to said primary housing and being oriented axially in a direction toward said initial fuse;

(e) a spring surrounding said hollow body and being arranged for urging said firing pin assembly towards said needle;

(f) a first safety slide radially displaceably held in said primer housing adjacent said first end of said hollow body; said first safety slide having a first position blocking an axial motion of said firing pin assembly towards said needle for preventing a contact between said initial fuse and said needle; said first safety slide having a second position allowing an axial motion of said firing pin assembly, urged by said spring, towards said needle to effect a contact between said initial fuse and said needle;

(g) a second safety slide radially displaceably held in said primer housing adjacent said second end of said hollow body; said second safety slide having a first position blocking an axial motion of said firing pin assembly in a direction away from said needle; said second safety slide having a second position allowing an axial motion of said firing pin assembly, urged by inertia against the force of said spring, away from said needle;

(h) a detonator held in said second safety slide such that in said first position of said second safety slide said detonator being out of axial alignment with said point and in said second position of said second safety slide said detonator being in axial alignment with said point for allowing contact between said point and said detonator; said detonator being operatively coupled to said final fuse and said explosive charge in the second position of said second safety slide;

(i) force-exerting means for urging said second safety slide from the first position in the second position thereof; and (j) interlocking means for preventing said second safety slide from moving from the first position to the second position thereof when said first safety slide is in its first position and for allowing said second safety slide to move, urged by said force-exerting means, from said first position to said second position thereof when said first safety slide is in its second position.

2. A warhead as defined in claim 1, wherein said spring is a first spring; further wherein said force-exerting means comprises a second spring positioned in said primer housing and being in engagement with said second safety slide.

3. A warhead as defined in claim 1, further comprising means defining a blind bore in said second safety slide; said blind bore being open towards said firing pin assembly; in said first position of said second safety slide said point projecting into said blind bore; said blind bore and said point constituting said interlocking means.

4. A warhead as defined in claim 1, further comprising means defining flame pass-through openings for providing passages for flames from said final fuse to said detonator.

5. A warhead as defined in claim 1, wherein said final fuse is an explosive fuse.

* * * * *